United States Patent [19]

Law et al.

[11] 4,428,855

[45] Jan. 31, 1984

[54] OIL-IN-WATER EMULSION FLUIDS

[75] Inventors: Derek A. Law, Pitman; Joosup Shim, Wenonah, both of N.J.

[73] Assignee: Mobil Oil Corporation, New York, N.Y.

[21] Appl. No.: 411,150

[22] Filed: Aug. 25, 1982

[51] Int. Cl.[3] ..... C10M 3/26

[52] U.S. Cl. ..... 252/77; 252/49.5; 252/51.5 R; 252/312

[58] Field of Search ..... 252/49.5, 51.5 R, 77, 252/312

[56] References Cited

U.S. PATENT DOCUMENTS 4,209,414 6/1980 Holgado et al. ..... 252/77

4,277,353 7/1981 Deen et al. ..... 252/77

*Primary Examiner*—John E. Kittle

*Assistant Examiner*—Robert A. Wax

*Attorney, Agent, or Firm*—Alexander J. McKillop; Michael G. Gilman; Howard M. Flournoy

[57] ABSTRACT

High water content fluids, i.e. oil-in-water emulsion hydraulic fluids are stabilized and/or made resistant to hard water by a co-emulsifier system consisting of water soluble alkyl alkanol amines or a heterocyclic amine.

11 Claims, No Drawings

OIL-IN-WATER EMULSION FLUIDS

BACKGROUND OF THE INVENTION

1. Field of the Invention

This invention relates to high water base emulsifiable fluids, particularly oil-in-water emulsions containing in addition to the usual prior art emulsifiers, a co-emulsifier system consisting of alkanol amines and/or heterocyclic amines or mixtures thereof.

2. Description of the Prior Art

The use of oil-in-water emulsion fluids as lubricants in industrial applications as, for example, hydraulic fluids, is known. In these fluids water is the continuous phase and the "oil" is in the dispersed phase. Further, the term oil is not limited to its usual meaning, but may include non-oil components, such as chemical additives, to the exclusion of oil in the dispersed phase.

High water content fluids (HWCF) of the type disclosed herein are usually prepared with various ratios of soft (distilled) water and oil or chemical concentrates. Many of these fluids, however, are unstable if modified, or if unmodified natural water instead of soft water is used. Their stability is affected by the ionic activity of salts present in hard water. Chelating agents have been used in the prior art as one means to overcome this problem. A new emulsifier system has now been developed which makes it possible for high water content fluids to remain stable under the most severe hard water conditions.

SUMMARY OF THE INVENTION

In accordance with the invention, there is provided a high water base oil-in-water emulsifiable fluid composition comprising a major amount of said fluid and a minor amount of water soluble alkyl alkanol amines or heterocyclic amines or mixtures thereof. These fluids are highly useful as improved hydraulic fluids.

DESCRIPTION OF PREFERRED EMBODIMENTS

The emulsifiable high water content fluids disclosed herein may contain from about 0.5 percent by weight to about 10 percent by weight of the emulsifiers in accordance with the present invention, preferably as little as from about 0.5 to about 2.5 percent by weight, and more preferably about 2 percent by weight, the remainder being said fluid or said fluid and other known additives. Typically, a fluid in accordance with this invention will broadly comprise from about 40 to about 99 percent by weight water, and preferably from about 50 to about 85 weight percent water. The remainder of the emulsion will comprise the base fluid and/or other additives. See Table 1 for the composition of a typical hydraulic fluid without the novel emulsifier system of this invention.

TABLE 1

COMPOSITION OF BASE HWCF FLUID (EXAMPLE 1)

| CHEMICAL TYPE | FUNCTION | % WT |
|---|---|---|
| Amine salts of succinic esters | Dispersant | 15.0 |
| Zinc Dithiophosphate | Antiwear | 10.0 |
| Amine salts of Organic Acids | Antirust | 5.0 |
| Alkylaryl polyether alcohol | Emulsifier | 10.0 |
| Alkylaryl polyether alcohol | Emulsifier | 3.0 |
| Water | Carrier | 57.0 |

The high water content fluids suitable for use herein encompass a wide range of percentages and components, and accordingly, are not restricted to the composition and percentages disclosed in Table 1. Any of a number of suitable additive materials may also be utilized in these fluids for their known purposes, without detrimental effect, e.g., dispersants, antiwear agents, antirust agents and prior art emulsifiers. Additionally the percentages of the respective components described in Table 1 may also vary within (practical) limits readily known to those of skill in the art.

The emulsifier system in accordance with this invention includes such alkanol amines as triethanolamine, isopropyl-aminoethanols, 2-amino-2-methyl-1-propanol, and various alkanol amines having the general formulas:

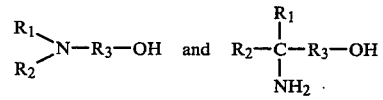

wherein $R_1$ and $R_2$ are alike or dissimilar $C_1$ to $C_4$ alkyl groups, and $R_3$ is $C_1$ to $C_4$ alkylene group, or heterocyclic amines having the general formula:

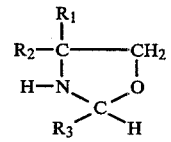

wherein $R_1$, $R_2$ and $R_3$ are alike or dissimilar $C_1$ to $C_4$ alkyl groups.

EVALUATION OF THE PRODUCT

The fluid described in Table 1 as the base reference fluid was subjected to a hard water stability test in the various formulations indicated in Table 2. Emulsion stability (data in Table 2) was determined by NCB UK National Coal Board, specification 463 from No. 19 superior emulsifying oil at a dilution rate of 20:1. This hard water stability test is the most severe and widely accepted hard water stability test. The test was conducted at 70° C. for 168 hours. The data is contained in Table 2.

Even though the representative prior art fluid described in Table 1 contains two non-ionic emulsifiers and a stabilizer, Table 2 shows its hard water tolerance is not sufficient enough to pass the stability test. Also the specific ingredients comprising it failed to provide all performance features required for HWCF and to meet the stability test requirements, but the unique combinations of these emulsifiers, stabilizers, alkanol amines and/or heterocyclic amines provide the desired performance as shown by Examples 2 through 5. Thus, the stability effect of specific additives in the oil-in-water emulsions embodied herein was demonstrated. The most preferred concentration as stated hereinabove of these additives, about 2% by weight, was used in the test. Higher levels were not tried since the desired result had been achieved at the low concentration. Other concentrations, of course, may be utilized depending on the specific HWCF.

TABLE 2

| HARD WATER STABILITY TEST* | EXAMPLE 1 | EXAMPLE 2 | EXAMPLE 3 | EXAMPLE 4 | EXAMPLE 5 | EXAMPLE 6 |
|---|---|---|---|---|---|---|
| Base Fluid | 100 | 98 | 98 | 98 | 98 | 98 |
| Triethanolamine | | 2.0 | | | | |
| Isopropylaminoethanolol(s) | | | 2.0 | | | |
| Heterocyclic Amine (oxazolidine) | | | | 2.0 | | |
| 2-Amino-2-Methyl-1-propanol | | | | | 2.0 | |
| Morpholines | | | | | | 2.0 |
| *NBC #19 Hard Water Stability (70° C., 168 hrs) | Fail | Pass | Pass | Pass | Pass | Fail |

The additives of the present invention are intended to enhance and supplement the emulsifiers normally used in prior art formulations. The data set forth in Table 2 clearly disclose that they accomplish their intended purpose.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

We claim:

1. A composition comprising an emulsifiable high water content fluid consisting essentially of said fluid and a co-emulsifier comprising a water soluble alkanol amine or amines having the general formulas:

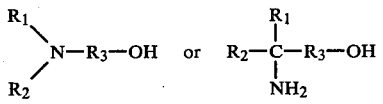

where $R_1$ and $R_2$ may be the same or different $C_1$ to $C_4$ alkyl groups and $R_3$ is a $C_1$ to $C_4$ alkylene group, mixtures thereof and mixtures of said alkanol amine and a heterocyclic amine having the general formula:

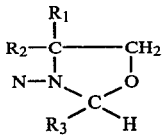

where $R_1$, $R_2$ and $R_3$ thereof are the same or different $C_1$ to $C_4$ alkyl groups.

2. The composition of claim 1 wherein the alkanol amine is selected from propylaminoethanol and 2-amino-2-methyl-1-propanol.

3. The composition of claim 2 wherein the alkanol amine is isopropylaminoethanol.

4. The composition of claim 2 wherein the alkanol amine is 2-amino-2-methyl-1-propanol.

5. The composition of claim 1 wherein the heterocyclic amine is oxazolidine.

6. The composition of claim 1 containing from about 0.5 to about 10% by weight of said co-emulsifier.

7. The composition of claim 6 containing about 2 weight percent of said co-emulsifier.

8. The composition of claim 1 having from about 40 to about 99 percent by weight of water.

9. The composition of claim 8 having about 50 to about 60% by weight of water.

10. An oil-in-water composition as described in claim 1 comprising an emulsifiable high water content fluid containing an additive package consisting essentially of one or more of the following: a dispersant, an antiwear agent, an antirust agent and suitable emulsifiers in addition to said co-emulsifier comprising water soluble alkanol amines and/or heterocyclic amines or mixtures thereof.

11. An oil-in-water composition as described in claim 1 comprising a emulsifiable high water content fluid adapted for use as a hydraulic fluid containing an additive package consisting essentially of one or more of the following: a dispersant, an antiwear agent, an antirust agent and suitable emulsifiers in addition to said co-emulsifier comprising water soluble alkanol amines, mixtures thereof or mixtures of said water soluble alkanol amine and said heterocyclic amine.

* * * * *

UNITED STATES PATENT AND TRADEMARK OFFICE

CERTIFICATE OF CORRECTION

PATENT NO. : 4,428,855

DATED : January 31, 1984

INVENTOR(S) : Derek A. Law et al.

It is certified that error appears in the above-identified patent and that said Letters Patent is hereby corrected as shown below:

Column 3, line 10, "Isopropylaminoethanolol(s)" should read

-- Isopropylaminoethanol(s) --.

Column 4, line 16, claim 3, "isopropylaminoethanol" should read

-- propylaminoethanol --.

Signed and Sealed this

*Sixth* Day of *November 1984*

[SEAL]

*Attest:*

GERALD J. MOSSINGHOFF

*Attesting Officer*

*Commissioner of Patents and Trademarks*